US005720103A

United States Patent [19]

West et al.

[11] Patent Number: 5,720,103

[45] Date of Patent: Feb. 24, 1998

[54] SELF-OPENING FINGER INSERTS FOR SCISSORS AND SHEARS

[75] Inventors: Wayne West, Little Genessee; John Carney, Friendship; Christopher Olix, Hornell, all of N.Y.

[73] Assignee: Heritage Cutlery, Inc., Bolivar, N.Y.

[21] Appl. No.: 742,801

[22] Filed: Nov. 1, 1996

[51] Int. Cl.[6] ..... B26B 13/20

[52] U.S. Cl. ..... 30/261; 30/232; 30/341

[58] Field of Search ..... 30/232, 261, 253, 30/341, 298, 254; D8/57; 7/131

[56] References Cited

U.S. PATENT DOCUMENTS

| | | | |
|---|---|---|---|
| D. 277,450 | 2/1985 | Hayashi | D8/57 |
| 606,472 | 6/1898 | Ogden | 30/341 |
| 664,613 | 12/1900 | Badger . | |
| 970,406 | 9/1910 | Tindall | 30/341 |
| 2,676,404 | 4/1954 | Peckron et al. | 30/261 |
| 3,921,478 | 11/1975 | Ygfors | 81/417 |
| 3,921,640 | 11/1975 | Freeborn | 30/261 |
| 3,974,563 | 8/1976 | Koch | 30/341 |
| 4,091,539 | 5/1978 | Watanabe | 30/341 |
| 4,254,551 | 3/1981 | Megna et al. | 30/341 |
| 5,109,608 | 5/1992 | Pracht | 30/232 |
| 5,279,034 | 1/1994 | Smith et al. | 30/232 |

FOREIGN PATENT DOCUMENTS

| | | | |
|---|---|---|---|
| 2725-919 | 12/1978 | Germany | 30/261 |

*Primary Examiner*—Hwei-Siu Payer
*Attorney, Agent, or Firm*—Brown, Pinnisi & Michaels

[57] ABSTRACT

A pair of self-opening scissors or shears, or an attachment which can be used with conventionally designed scissors or shears, particularly of the kind used by barbers or the like. The invention uses a pair of inserts for the finger holes of the scissors, connected by a band of an elastic material which serves to provide a self-opening force. The inserts fit into the finger holes, simultaneously holding the elastic band and reducing the size of the finger holes for smaller hands. The self-opening finger inserts of the invention can be used with existing scissors, or built into new scissors at time of manufacture without requiring major redesign or changes in manufacture. The scissors with the invention will reduce repetitive motion injury while remaining conventional in shape and feel.

16 Claims, 1 Drawing Sheet

SELF-OPENING FINGER INSERTS FOR SCISSORS AND SHEARS

FIELD OF THE INVENTION

The invention pertains to the field of attachments for the handles of cutlery of the type having two pivoting blades, commonly known as scissors or shears. More particularly, the invention pertains to ergonomic additions to scissors or shears to bias the handles toward an open position.

BACKGROUND OF THE INVENTION

In recent years medical science has recognized the prevalence of repetitive-motion injury in occupations requiring constant use of the hands. In order to avoid such injury, a worker can avoid the repetitive motions, or the tools can be modified to reduce the effort involved.

Persons who need to use scissors a great deal, such as barbers, hair stylists, seamstresses and the like are prone to repetitive motion injury caused by the need to open the blades of the scissors. Such motion requires the hand to exert an opening force, which is opposite to the natural gripping force for which the human hand is designed, and over time will result in painful strain of the hand muscles. If the scissor is designed to provide its own opening force then the user's hand need only exert the more natural force of a closing grip.

Self-opening scissors have been known for many years. The following patents serve as examples of prior-art self-opening scissors.

Badger's "SCISSORS", U.S. Pat. No. 664,613, issued in 1900, is an early example of self-opening scissors. Instead of the conventional finger holes, the scissor has straight handles joined by a coiled spring.

Peckron's "SPRING OPENER FOR SCISSORS", U.S. Pat. No. 2,676,404, issued in 1954 is an attempt to provide a self-opening function for existing scissors. It uses a metal spring element which clips around one handle of the scissors, and runs along the other handle. Peckron's opener will only operate on certain designs of scissors, and may tend to rotate and slip off the handle rather than spring-open.

Ygfors, U.S. Pat. No. 3,921,478, "TOOL, SUCH AS A PAIR OF PLIERS OR SCISSORS", issued in 1975, is similar to Badger, in that the conventional finger holes again need to be replaced by straight handles. A spring band connects the ends of the handles to perform the self-opening function.

Smith's "SCISSORS", U.S. Pat. No. 5,279,034, issued in 1994, are an ergonomic scissors using a special handle design which are connected by an elastic band. Again, the scissors use a special handle design, rather than the conventional finger holes.

Two design patents for "SCISSORS" Design Pat. Nos. 354,423 and 361,705 issued in 1995 to Birkholz show a band between the parts of a unitary handle which is presumably elastic. Although the design of the finger-holes are more or less conventional, this is yet another special handle design in that the two finger halves are in fact one unitary casting.

Another factor which has proven a problem is the fact that conventional barbering scissors have in the past been made with fairly large finger holes, to fit the larger fingers of male barbers. These scissors have been less comfortable and useful for the smaller fingers of female barbers and stylists, which have come to dominate the business in recent years. The prior art has provided plastic finger rings to reduce the size of the finger holes in scissors, but these perform no self-opening function to aid with repetitive-motion injury.

SUMMARY OF THE INVENTION

The invention provides an attachment which can be used with conventionally designed scissors or shears, particularly of the kind used by barbers or the like. The invention uses a pair of inserts for the finger holes of the scissors, connected by a band of an elastic material which serves to provide a self-opening force. The inserts fit into the finger holes, simultaneously holding the elastic band and reducing the size of the finger holes for smaller hands.

The self-opening finger inserts of the invention can be used with existing scissors or shears, or built into new products at time of manufacture without requiring major redesign or changes in manufacture. The invention will reduce repetitive motion injury while allowing the scissors or shears to remain conventional in shape and feel.

DESCRIPTION OF THE PREFERRED EMBODIMENT

Figure 1:
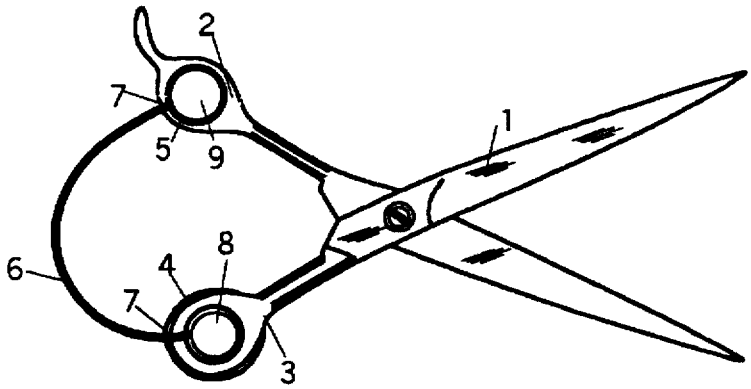
FIG. 1 shows a pair of scissors with the invention installed.

FIG. 1 shows a pair of scissors (1) with the invention installed. The scissor design shown is a conventional barber's scissors, the scissors (1) having a nearly circular finger holes (8) and (9) in the handles (3) and (2), respectfully.

The invention comprises finger inserts (4) and (5), which are inserted into the finger holes (8) and (9). The finger inserts are preferably of slightly differing designs, as shown in the figures, in which insert (4) flares out to overlap the outside of the handle (3), while the other insert (5) remains more or less inside finger hole (9).

While "scissors" and "shears" are often used interchangeably, it should be noted that in the industry the words "scissors" and "shears" refer to two different products. "Shears" are cutting implements similar to scissors, but having one round thumb hole in one handle and an elongated oval hole for several fingers in the other handle. The invention is equally applicable to either, with the inserts shaped to fit whichever set of finger holes is used on the product. Therefore, for the purposes of this specification and claims, the word "scissors" is intended to include both true scissors and shears.

Connecting the two inserts (4) and (5) is a resilient elastomeric strap (6), which serves to exert an opening force on the scissor handles through the finger inserts. The strap (6) passes sideways through slots (7) formed in the finger rings of the scissor handles. If the invention is to be used with existing scissors, then these slots (7) will need to be cut to allow the strap (6) to pass through. The strap may be made of a resilient plastic material such as nylon or Thermal Plastic Olefin (TPO), or other plastic or similar appropriate material which has the desired characteristics.

Figure 2:
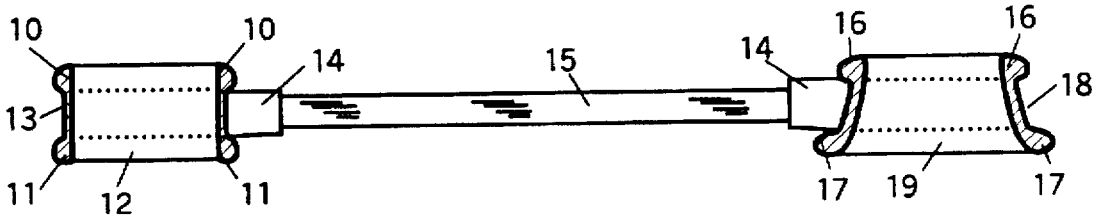
FIG. 2 shows a top view of the invention, removed from scissors, with the finger inserts cut-away.
Figure 3:
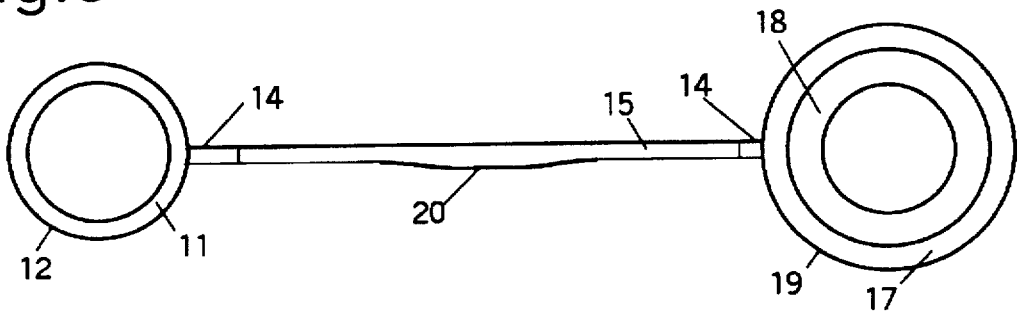
FIG. 3 shows a side view of the invention, removed from scissors.

FIGS. 2 and 3 show views (cut-away in FIG. 2) of a pair of finger inserts (12) and (19) according to the invention, connected by resilient strap (15). The strap (15) is preferably formed integral with the finger inserts (12) and (19), with a flat tab (14) provided to slip through the slots in the scissor handles. Alternatively, the strap could be attached through adhesive or other means to the finger inserts, possibly through a slot in the inserts. In the latter case, it is preferred that the inside of the finger inserts remains smooth so as to avoid discomfort.

Referring to the cut-away view of the simpler cylindrical finger insert (12), it will be seen that the insert comprises a pair of generally tubular flanges (10) and (11), connected by a cylindrical web (13). The insert is preferably made of elastic material, which allows the insert to be slipped into the finger hole of the scissors, and held in place by the flanges.

As an example, in a preferred embodiment for 10 inch barber scissors as shown in FIG. 1, the flanges (10) and (11) are approximately 0.055 inch in diameter. The cylindrical web (13) is preferably 1.057 inches in diameter, 0.078 inches in height, and 0.053 in thickness.

For thumb holes or larger finger holes, a more complex design shown in insert (19) can be used, to fit the flared design of the scissors. Again, a pair of flanges (16) and (17) with a web between (18) allow the insert to be slipped into the finger hole of the scissors. The tiara design allows the outer flange (17) to protrude over the finger hole of the scissors for greater comfort.

In the preferred embodiment shown in FIG. 1 in use on a pair of 10 inch hair scissors, the strap is approximately 4.375 inches in length, 0.188 inches in height and between 0.075 to 0.108 inch in thickness, with the thicker portion in the middle.

Figure 4:
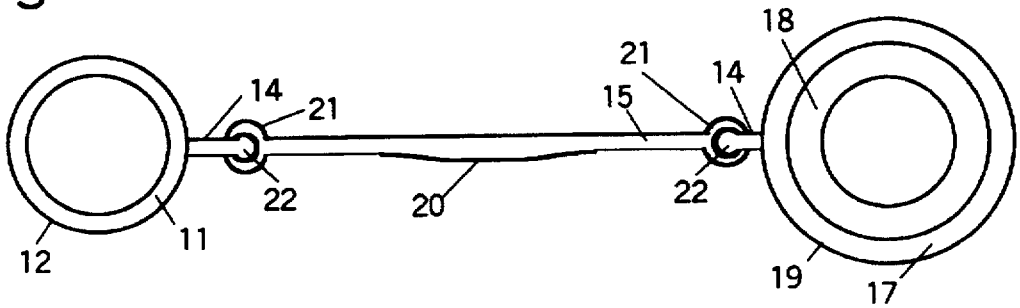
FIG. 4 shows a side view of an alternative embodiment of the invention, with a replaceable elastic band.

The embodiment of the invention shown in the first three figures uses a resilient strap element (15) which is molded from the same material as the finger inserts. It has been found in some applications that this strap element may fatigue over time, and need to be replaced. A thick portion (20) provides additional strength to strap 15. FIG. 4 shows an embodiment of the invention in which the strap (15) is replaceable. The finger inserts are of the same design as in FIGS. 2 and 3. The flat tabs (14) connecting the finger inserts to the resilient strap (15) are formed with cylindrical sections (22) on their ends. The strap (15) is formed with mating gripping sections (21), which snap over the cylindrical sections (22) of the tabs (14), allowing the strap (15) to be attached and removed from the finger inserts. Other mating methods between the strap and the finger insert tabs may also be used, such as matching slot and tab arrangements, interlocking hooks or rings, etc.

What is claimed is:

1. A pair of improved scissors of the kind having a pair of pivoted cutting blades, each blade having an associated handle, each handle having at least one finger hole for the fingers of an operator, the improvement comprising:

a) a first and a second generally cylindrical finger inserts, each being formed to fit into a finger hole of one of the handles of the scissors, and b) an elastomeric strap connecting the first finger insert and the second finger insert, such that the elastomeric strap biases the first and second finger inserts apart, exerting a force on the finger holes of the handles, and causing the handles of the scissors to be biased apart, such that the scissors are self-opening.

2. The improved scissors of claim 1, in which each of the first and the second finger inserts comprises:

a) a generally cylindrical body having an outside diameter and an inside diameter and two ends with a height between, and a smooth interior, the outside diameter of the cylindrical body being slightly smaller than the finger hole of the handle into which the insert is to fit and the height being substantially equal to the thickness of the handle having the finger hole; and b) a first flange and a second flange, located at the ends of the cylindrical body, each having an outside diameter slightly larger than the outside diameter of the cylindrical body and also larger than the finger hole of the handle into which the insert is to fit, and an inside diameter substantially equal to that of the cylindrical body;

c) the first flange and the second flange and the cylindrical body being made of elastic material such that the finger insert may be deformed to be inserted into the finger hole, and then will resume its shape, with the first flange and the second flange holding the cylindrical body into the finger hole.

3. The improved scissors of claim 1, in which the elastomeric strap is formed integrally with the first finger insert and .the second finger insert.

4. The improved scissors of claim 1, further comprising:

a) a tab attached to each finger insert, having a first end attached to the finger insert and a second end having linking means for attachment; and b) linking means located on each end of the elastomeric strap, the linking means being selected to match with the linking means of the tabs, such that the elastomeric strap can be removably attached to the finger inserts by means of the linking means on the elastomeric strap and the linking means on the tabs.

5. The improved scissors of claim 1, in which the elastomeric strap is formed of plastic material.

6. The improved scissors of claim 5, in which the elastomeric strap is formed of nylon.

7. The improved scissors of claim 5, in which the elastomeric strap is formed of thermal plastic olefin.

8. The improved scissors of claim 1, in which at least one of the handles further comprises a slot passing through the handle from the finger hole, such that the elastomeric strap passes from the finger insert through the slot.

9. A self-opening attachment for use with scissors of the kind having a pair of pivoted cutting blades, each blade having an associated handle, each handle having at least one finger hole for the fingers of an operator, the attachment comprising:

a) a first and a second generally cylindrical finger inserts, each being formed to fit into a finger hole of one of the handles of the scissors, and b) an elastomeric strap connecting the first finger insert and the second finger insert, such that the elastomeric strap biases the first and the second finger inserts apart, exerting a force on the finger holes of the handles, and causing the handles of the scissors to be biased apart, such that the scissors are self-opening.

10. The self-opening attachment of claim 9, in which each of the first finger insert and the second finger insert comprises:

a) a generally cylindrical body having an outside diameter and an inside diameter and two ends with a height between, and a smooth interior, the outside diameter of the cylindrical body being slightly smaller than the finger hole of the handle into which the insert is to fit and the height being substantially equal to the thickness of the handle having the finger hole; and b) a first flange and a second flange, located at the ends of the cylindrical body, each having an outside diameter slightly larger than the outside diameter of the cylindrical body and also larger than the finger hole of the handle into which the insert is to fit, and an inside diameter substantially equal to that of the cylindrical body;

the first flange and the second flange and the cylindrical body being made of elastic material such that the finger insert may be deformed to be inserted into the finger hole, and then will resume its shape, with the first flange and the second flange holding the cylindrical body into the finger hole.

11. The self-opening attachment of claim 9, in which the elastomeric strap is formed integrally with the first finger insert and the second finger insert.

12. The self-opening attachment of claim 9, further comprising:

a) a tab attached to each finger insert, having a first end attached to the finger insert and a second end having linking means for attachment; and b) linking means located on each end of the elastomeric strap, the linking means being selected to match with the linking means of the tabs, such that the elastomeric strap can be removably attached to the finger inserts by means of the linking means on the elastomeric strap and the linking means on the tabs.

13. The self-opening attachment of claim 9, in which the elastomeric strap is formed of plastic material.

14. The self-opening attachment of claim 13 in which the elastomeric strap is formed of nylon.

15. The self-opening attachment of claim 13, in which the elastomeric strap is formed of thermal plastic olefin.

16. The self-opening attachment of claim 9, in which at least one of the handles is modified by cutting a slot passing through the handle from the finger hole, such that the elastomeric strap passes from the finger insert through the slot.

* * * * *